US006010330A

United States Patent [19]

Helton et al.

[11] Patent Number: 6,010,330

[45] Date of Patent: Jan. 4, 2000

[54] FAIRED LIP PROTUBERANCE FOR A BURNER NOZZLE

[75] Inventors: Woodward Clinton Helton; Daniel Isaiah Saxon; Stacey Elaine Swisher; Gary Scott Whittaker, all of Kingsport, Tenn.

[73] Assignee: Eastman Chemical Company, Kingsport, Tenn.

[21] Appl. No.: 08/833,455

[22] Filed: Apr. 7, 1997

[51] Int. Cl.[7] ..... F23D 1/02; F23D 15/02; C10J 3/48

[52] U.S. Cl. ..... 431/160; 431/187; 431/9; 431/116; 110/264; 239/132.3

[58] Field of Search ..... 431/8, 9, 181, 431/187, 160, 115, 116, 159; 100/260, 261, 262, 263, 264; 239/132.1, 132.3

[56] References Cited

U.S. PATENT DOCUMENTS

| | | | |
|---|---|---|---|
| 2,809,104 | 10/1957 | Strasser et al. | 48/215 |
| 3,576,384 | 4/1971 | Peczeli | 431/353 |
| 3,852,022 | 12/1974 | Medeot et al. | 431/186 |
| 4,105,395 | 8/1978 | Goodnight et al. | 431/351 |
| 4,350,103 | 9/1982 | Poll | 110/263 |
| 4,502,633 | 3/1985 | Saxon | 239/132.3 |
| 5,542,841 | 8/1996 | Nakashima et al. | 431/160 |

*Primary Examiner*—Carl D. Price

*Attorney, Agent, or Firm*—Harry J. Gwinnell; Matthew W. Smith; Susan F. Wagner

[57] ABSTRACT

The operational life of a synthesis gas generation reactor burner nozzle is improved, at least about 14%, by a faired lip around the nozzle discharge orifice projecting about 0.95 cm from the nozzle end face. The lip is faired with a 45° conical angle from the nozzle face. A smooth transition of recirculated gas flow across the nozzle face into the reactive material discharge column is believed to promote an attached static or laminar flowing boundary layer of cooled gas that insulates the nozzle face, to a degree, from the emissive heat of the combustion reaction.

14 Claims, 3 Drawing Sheets

FAIRED LIP PROTUBERANCE FOR A BURNER NOZZLE

BACKGROUND OF THE INVENTION

The present invention relates to apparatus for practicing a partial oxidation process of synthesis gas generation. In particular, the present invention is applicable to the generation of carbon monoxide, carbon dioxide, hydrogen and other gases by the partial combustion of a particulate hydrocarbon such as coal in the presence of water and oxygen.

Synthesis gas mixtures essentially comprising carbon monoxide and hydrogen are important commercially as a source of hydrogen for hydrogenation reactions and as a source of feed gas for the synthesis of hydrocarbons, oxygen-containing organic compounds or ammonia.

The partial combustion of a sulfur bearing hydrocarbon fuel such as coal with oxygen-enriched air or with relatively pure oxygen to produce carbon monoxide, carbon dioxide and hydrogen presents unique problems not encountered normally in the burner art. It is necessary, for example, to effect very rapid and complete mixing of the reactants, as well as to take special precautions to protect the burner or mixer from over heating.

Because of the reactivity of oxygen and sulfur contaminants with the metal from which a suitable burner may be fabricated, it is imperative to prevent the burner elements from reaching those temperatures at which rapid oxidation and corrosion takes place. In this respect, it is essential that the reaction between the hydrocarbon and oxygen take place entirely outside the burner proper and that localized concentration of combustible mixtures at or near the surfaces of the burner elements is prevented. Even though the reaction takes place beyond the point of discharge from the burner, the burner elements are subjected to heating by radiation from the combustion zone and by turbulent recirculation of the burning gases.

For these and other reasons, prior art burners are characterized by failures due to metal corrosion about the burner tips: even when these elements have been water cooled and where the reactants have been premixed and ejected from the burner at rates of flow in excess of the rate of flame propagation.

It is therefore an object of the present invention to provide a novel burner for synthesis gas generation which is an improvement over the shortcomings of prior art appliances, is simple in construction and economical in operation.

Another object of the invention is to provide a synthesis gas generation burner nozzle having a greater operational life expectancy over the prior art.

Another object of the present invention is to provide a gas generation burner nozzle for synthesis gas generation having a reduced rate of corrosion.

A further object of the present invention is the provision of burner nozzle temperature reduction by management of the recirculating combustion gases.

Also an object of the present invention is a burner nozzle surface geometry found to reduce the burner nozzle corrosion rate.

A still further object of the present invention is a surface temperature control mechanism for burner nozzles.

SUMMARY OF THE INVENTION

These and other objects of the invention as will become apparent from the detailed description of the preferred embodiment to follow are achieved by a substantially symmetric, axial flow fuel injection nozzle serving the combustion chamber of a synthesis gas generator. The nozzle is configured to have an annular slurried fuel stream that concentrically surrounds a first oxidizer gas stream along the axial core of the nozzle.

A second oxidizer gas stream surrounds the fuel stream annulus as a larger, substantially concentric annulus.

The fuel stream comprises a pumpable slurry of water mixed with finely particulated coal. The oxidizer gas contains substantial quantities of free oxygen for support of a combustion reaction with the coal.

A hot gas stream is produced in the refractory-lined combustion chamber at a temperature in the range of about 700° C. to 2500° C. and at a pressure in the range of about 1 to about 300 atmospheres and more particularly, about 10 to about 100 atmospheres. The effluent raw gas stream from the gas generator comprises hydrogen, carbon monoxide, carbon dioxide and at least one material selected from the group consisting of methane, hydrogen sulfide and nitrogen depending on the fuel and reaction conditions.

Radially surrounding a conical outer wall of the outer oxidizer gas nozzle is an annular cooling water jacket terminated with a substantially flat end-face heat sink aligned in a plane substantially perpendicular to the nozzle discharge axis.

Around the outer rim of the outer oxidizer gas annulus is a tapered thickness lip that projects to a ridge about 0.95 cm from the plane of the heat sink end-face. From the lip ridge, the heat sink structure between inside and outside surface cones diverges at approximately 15°. The outside cone surface intersects the heat sink end-face plane at a faired transition angle of about 45°. The internal cone surface is formed to about 30° with respect to the end-face plane.

Combustion reaction components comprising the fuel and oxidizer are sprayed under significant pressure of about 80 bar into the combustion chamber of the synthesis gas generator. A torroidial circulation pattern within the combustion chamber carries hot gas along an axially central course out from the nozzle face. Distally from the nozzle face, the gases begin to cool and spread radially outward toward the chamber walls. While most of the combustion product and resulting synthesis gas is drawn from the combustion chamber into a quench vessel, some of the synthesis gas recirculates against the combustion chamber walls toward the nozzle end of the chamber, all the while transferring heat to the refractory wall.

At the upper or nozzle end of the chamber, the cooler gas is drawn radially inward toward the nozzle discharge orifice and across the outer face plane of the nozzle end heat sink before being drawn into and along with the combustion core column.

Due to a faired transition of the present invention nozzle lip, this cooler gas recirculation annulus is believed to remain attached to the nozzle end wall as a static or laminar flow boundary layer. Service life of the burner nozzle is extended by as much as 14%. If correctly understood, such a static or slowly moving gas layer effectively insulates the nozzle face from a radiant influx of extreme combustion heat and reduces the reactivity of the nozzle end wall base metal with hydrogen sulfide gas combustion products, for example.

BRIEF DESCRIPTION OF THE DRAWINGS

Further objects and characteristics of the invention will be understood from the following description of the preferred embodiment taken in connection with the drawings wherein.

DESCRIPTION OF THE PREFERRED EMBODIMENT

Figure 1:
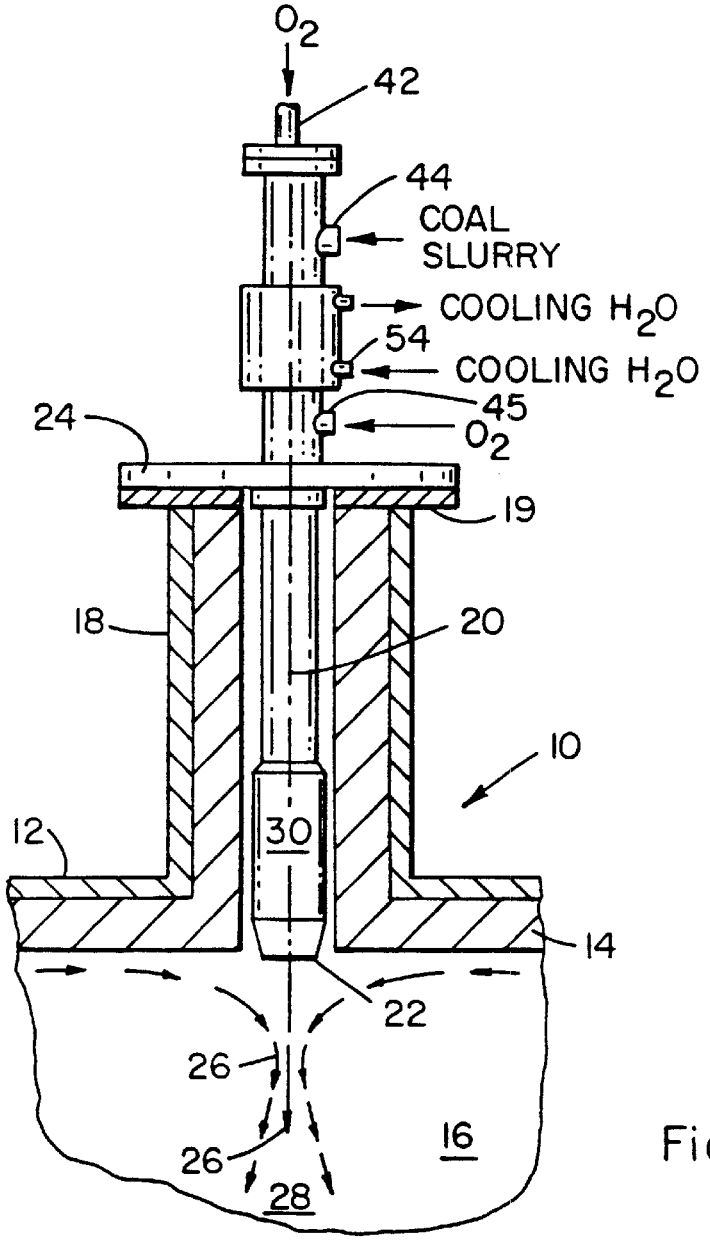
FIG. 1 is a partial sectional view of a synthesis gas generator combustion chamber and burner.

Relative to the drawings wherein like reference characters designate like or similar elements throughout the several figures of the drawing, FIG. 1 partially illustrates a synthesis gas reactor vessel 10 constructed with a structural shell 12 and an internal refractory liner 14 around an enclosed combustion chamber 16. Projecting outwardly from the shell wall is a burner mounting neck 18 for supporting an elongated fuel injection "burner" assembly 20 within the reactor vessel aligned to locate the face 22 of the burner head substantially flush with the inner surface of the refractory liner 14. A burner mounting flange 24 secured to the burner assembly 20 interfaces with a mounting neck flange 19 to secure the burner assembly 20 against the internal pressure of the combustion chamber 16.

Figure 2:
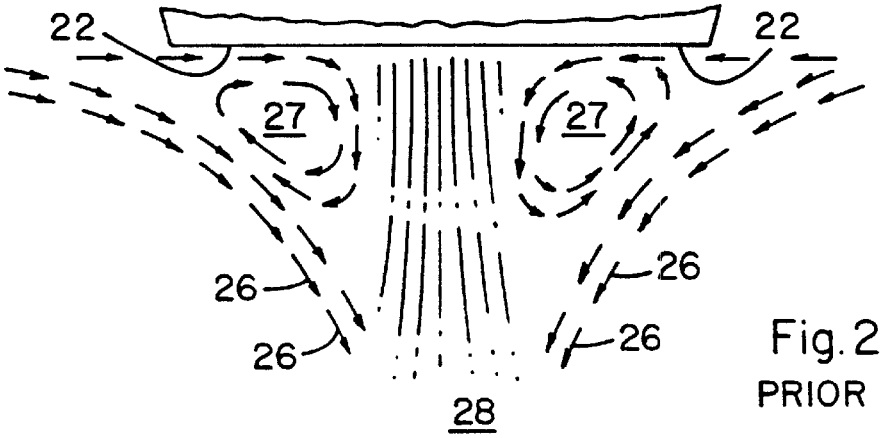
Fig. 2 PRIOR ART
FIG. 2 is a detail of the combustion chamber gas dynamics at the burner nozzle face.

Gas flow direction arrows 26 of FIGS. 1 and 2 partially represent the internal gas circulation pattern within the combustion chamber driven by the high temperature and high velocity reaction core 28 issuing from the nozzle assembly 30. Depending on the fuel and induced reaction rate, temperatures along the reaction core may reach as high as 2500° C. As the reaction gas cools toward the end of the chamber 16 opposite from the nozzle 30, most of the gas is drawn into a quench chamber similar to that of the synthesis gas process described by U.S. Pat. No. 2,809,104 to Dale M. Strasser et al. However, a minor percentage of the gas spreads radially from the core column 28 to cool against the reaction chamber enclosure walls. The recirculation gas layer is pushed upward to the top center of the reaction chamber where it is drawn into the turbulent down flow of the combustion column 28.

With respect to the prior art model of FIG. 2, at the confluence of the recirculation gas with the high velocity core column 28 a toroidal eddy flow 27 turbulently scrubs the burner head face 22 thereby enhancing opportunities for chemical reactivity between the burner head face material and the highly reactive, corrosive compounds carried in the combustion product recirculation stream.

One of the economic advantages of a coal fed synthesis gas process is the abundance of inexpensive, high sulfur coal which is reacted within the closed combustion chamber to release both free sulfur and hydrogen sulfide. From these sources, high value industrially pure sulfur and sulfur bearing compounds may be formed. Within the reaction chamber 16, however, such sulfur compounds tend to react with the cobalt base metal alloys from which the burner head face 22 is fabricated to form cobalt sulfide at extremely high temperatures. Since the cobalt fraction of this reaction is leached from the burner structure, a self-consumptive corrosion is sustained that ultimately terminates with failure of the burner assembly 20.

Although considerably cooler combustion product gases lay within the chamber 16 as a boundary layer against the refractory walls, the gases in direct, scrubbing contact with prior art burner nozzle faces tend to be extremely hot and turbulent.

Figure 3:
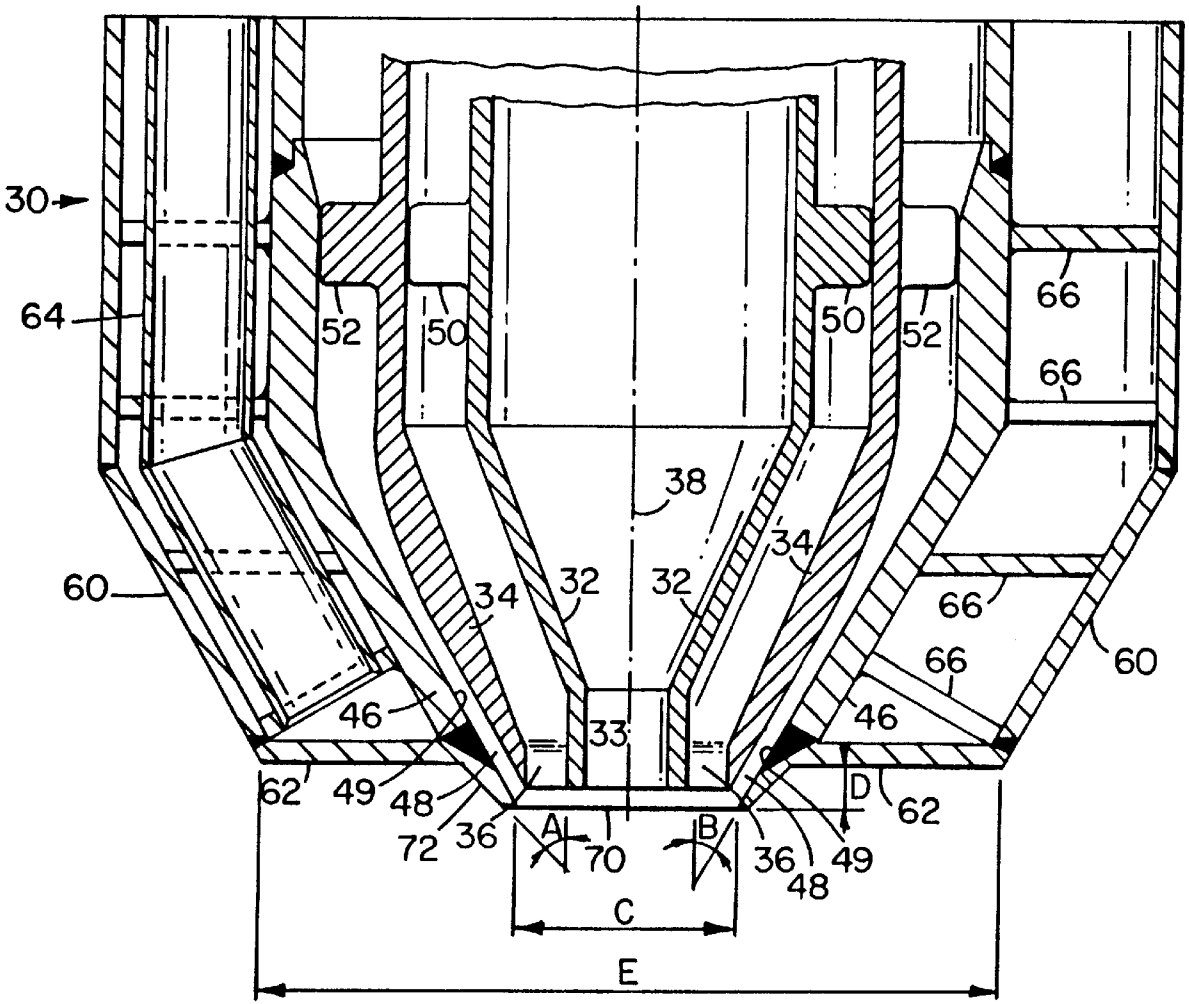
FIG. 3 is a partial sectional view of a synthesizing gas burner nozzle constructed according to a preferred embodiment of the invention; and, FIG. 4 is an elevational view of an alternative embodiment of the invention.

With respect to FIG. 3, the burner assembly 20 of the present invention includes an injector nozzle assembly 30 comprising three concentric nozzle shells and an outer cooling water jacket. The internal nozzle shell 32 discharges from an axial bore opening 33 the oxidizer gas that is delivered along upper assembly axis conduit 42. Intermediate nozzle shell 34 guides the particulated coal slurry delivered to the upper assembly port 44. As a fluidized solid, this coal slurry is extruded from the annular space 36 between the inner shell wall 32 and the intermediate shell wall 34. The outer, oxidizer gas nozzle shell 46 surrounds the outer nozzle discharge annulus 48 formed between the interior surface 49 of the outer shell and the outer surface of the intermediate shell 34. The upper assembly port 45 supplies the outer nozzle discharge annulus with an additional stream of oxidizing gas.

Centralizing fins 50 radiating from the outer surface of the inner shell 32 wall bear against the interior wall of the intermediate shell 34 to keep the inner shell 33 coaxially centered relative to the intermediate shell axis. Similarly, centralizing fins 52 radiate from the intermediate shell 34 to coaxially confine it within the outer shell 46. It will be understood that the structure of the fins 50 and 52 form discontinuous bands about the inner and intermediate shells and offer small resistance to fluid flow within the respective annular spaces.

As described in greater detail by U.S. Pat. No. 4,502,633 to D. I. Saxon, the internal nozzle shell 32 and intermediate nozzle shell 34 are both axially adjustable relative to the outer nozzle shell 46 for the purpose flow capacity variation. As intermediate nozzle 34 is axially displaced from the conically tapered internal surface of outer nozzle 46, the outer discharge annulus 48 is enlarged to permit a greater oxygen gas flow. Similarly, as the outer tapered surface of the internal nozzle 32 is axially drawn toward the internally conical surface of the intermediate nozzle 34, the coal slurry discharged area 36 is reduced.

Surrounding the outer nozzle shell 46 is a coolant fluid jacket 60 having a planar end-face closure 62. A coolant fluid conduit 64 delivers coolant such as water from the upper assembly supply port 54 directly to the inside surface of the end-face closure plate 62. Flow channeling baffles 66 control the coolant flow course around the outer nozzle shell, assure substantially uniform heat extraction, prevent coolant channeling and reduce localized hot spots.

Preferably, the nozzle assembly 30 components are fabricated of extremely high temperature resistant material such as an R30188 metal as defined by the Unified Numbering System for Metals and Alloys. This material is a cobalt base metal that is alloyed with chrome and tungsten. Other high temperature melting point alloys such as molybdenum, tungsten or tantalum may also be used.

Figure 4:
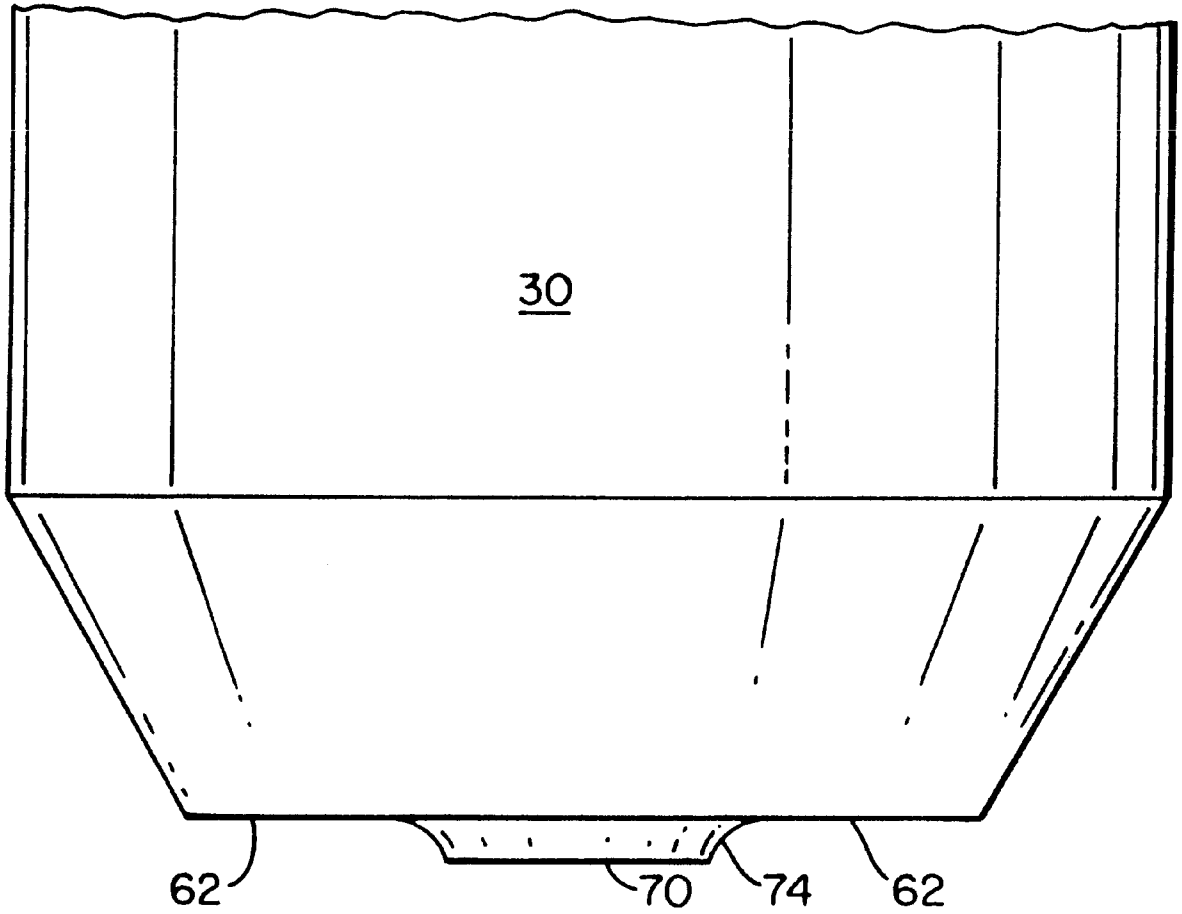

As an extension of the outer nozzle shell, a nozzle lip 70 projects from the coolant jacket end-face closure 62 with a relatively narrow angle of web thickness. For example, the outer cone surface 72 of the lip may be formed to a 45° angle A with the nozzle axis 38. If the inner cone surface 49 of the lip is given a 30° angle B relative to the nozzle axis 38, the web angle of the lip is only 15°, for example. An alternative embodiment of the invention is illustrated by FIG. 4 to show the surface transition of the nozzle coolant jacket end-face-therefor 62 into the lip ridge with a coved fillet 74.

In a specific example, an R30188 fabricated lip 70 around an approximately 5.1 cm outer nozzle opening C was given an approximate 0.95 cm projection D from the plane of the end-face 62. The end-face 62 outer diameter E was about 17 cm.

Having described our invention in detail with particular reference to the preferred embodiment, it will be understood that variations and modifications can be implemented within the scope of the invention disclosed.

We claim:

1. A burner nozzle for injecting a plurality of fluidized fuel and oxidizing materials into a combustion chamber, said burner nozzle comprising:

an elongated outer shell having a longitudinal nozzle discharge axis and a plurality of elongated circumferentially reduced inner shells, said shells defining at least two annular channels surrounding a central channel and having upstream and downstream ends defining upstream and downstream orifices transected by said longitudinal axis;

a coolant jacket enveloping said outer shell and defined by an annular end-face heat sink radially extending from said downstream end of said outer shell beyond a first perimeter to an outermost second perimeter from which longitudinally extends a cylindrical outer wall; and a conical annular nozzle lip projecting from said annular end-face heat sink and defined by an outside surface having a first upper end downwardly extending from said first perimeter of said annular end-face heat sink to a first lower end of said outside surface and an inside surface having a second upper end downwardly extending from said downstream end of said outer shell to a second lower end of said inside surface, said first and second upper ends defining an upper nozzle portion having a first transverse width, said first and second lower ends defining an annular truncated nozzle ridge having a second transverse width, wherein said first width is greater than said second width.

2. The burner nozzle according to claim 1 wherein said outside surface of said nozzle lip extends at a first angle "A" relative to said longitudinal axis, and said inside surface extends at a second angle "B" relative to said longitudinal axis, wherein said second angle is smaller than said first angle.

3. The burner nozzle according to claim 2 wherein said nozzle lip is tapered so that said first angle "A" is 45° relative to said longitudinal axis and said second angle "B" is 30° relative to said longitudinal axis.

4. The burner nozzle according to claim 1 wherein said nozzle lip is a heat sink in thermally conductive communication with said annular end-plate heat sink.

5. The burner nozzle according to claim 1 wherein said outside surface of said nozzle lip extends downwardly from said first perimeter of said annular end-face heat sink in a direction forming a faired angle with said annular end-face heat sink and converging at said longitudinal axis.

6. The burner nozzle according to claim 5 wherein said faired angle is 45°.

7. The burner nozzle according to claim 1, said ridge of said nozzle lip being positioned at a longitudinal distance below said annular end-face and having an inner diameter, wherein the ratio of said distance to said inner diameter is about 0.95:5.1, further wherein the ratio of said distance to the diameter of said outermost perimeter of said annular end-face heat sink is about 0.95:17.

8. The burner nozzle according to claim 1 wherein said central channel is configured to deliver an oxidizer gas stream and said at least two annular channels includes an annular channel configured to deliver a slurried fuel stream, surrounded by another annular channel defined by said outer shell and configured to deliver an oxidizer gas stream.

9. The burner nozzle according to claim 1 wherein said annular end-face heat sink lies substantially perpendicular to said longitudinal axis.

10. The burner nozzle according to claim 1 wherein said burner nozzle is fabricated of a high temperature resistant metal alloy.

11. The burner nozzle according to claim 1 wherein said nozzle lip has a concave outside surface extending between said first upper end and said first lower end, said concavity being in the direction of said longitudinal axis.

12. The burner nozzle according to claim 11 wherein said concave outside surface intersects said first perimeter of said annular end-face heat sink at a faired angle relative to said annular end-face heat sink.

13. The burner nozzle according to claim 12 wherein said faired angle is 45°.

14. A synthesis gas combustion chamber assembly comprising:

a reactor vessel having an internal refractory liner around an enclosed combustion chamber; and a burner nozzle including an elongated outer shell having a longitudinal nozzle discharge axis and a plurality of elongated circumferentially reduced inner shells, said shells defining at least two annular channels surrounding a central channel and having upstream and downstream ends defining upstream and downstream orifices transected by said longitudinal axis, a coolant jacket enveloping said outer shell and defined by an annular end-face heat sink radially extending from said downstream end of said outer shell beyond a first perimeter to an outermost perimeter out of which longitudinally extends a cylindrical outer wall, a conical annular nozzle lip downwardly projecting from said annular end-face heat sink and defined by an outside surface having a first upper end downwardly extending from said first perimeter of said annular end-face heat sink to a first lower end of said outside surface and an inside surface having a second upper end downwardly extending from said downstream end of said outer shell to a second lower end of said inside surface, said first and second upper ends defining an upper nozzle portion having a first transverse width, said first and second lower ends defining an annular truncated nozzle ridge having a second transverse width, wherein said first width is greater than said second width, wherein said reactor vessel is adapted to receive said annular end-face heat sink of said burner nozzle into said enclosed combustion chamber.

* * * * *